US006056678A

United States Patent [19]

Giannelli et al.

[11] Patent Number: 6,056,678

[45] Date of Patent: May 2, 2000

[54] ARM CURL APPARATUS FOR EXERCISING REGIONS OF THE UPPER BODY

[75] Inventors: Raymond Giannelli, Franklin, Mass.; Jerry K. Leipheimer, Jamestown, Pa.

[73] Assignee: Cybex Inaternational, Inc., Medway, Mass.

[21] Appl. No.: 08/940,894

[22] Filed: Sep. 30, 1997

Related U.S. Application Data

[60] Provisional application No. 60/027,054, Sep. 30, 1996.

[51] Int. Cl.[7] ..... A63B 23/12

[52] U.S. Cl. ..... 482/137; 482/100; 482/139

[58] Field of Search ..... 482/100, 136, 482/139

[56] References Cited

U.S. PATENT DOCUMENTS

| | | | |
|---|---|---|---|
| 4,411,424 | 10/1983 | Barnett | 482/138 |
| 4,563,003 | 1/1986 | Bugallo et al. | 482/100 |
| 5,116,297 | 5/1992 | Stonecipher | 482/137 X |
| 5,437,589 | 8/1995 | Habing | 482/100 X |
| 5,562,577 | 10/1996 | Nichols, Sr. et al. | 482/137 X |

OTHER PUBLICATIONS

"Swivel Grip" Brochure, Copy in 482/139, 1994.

*Primary Examiner*—John Mulcahy

[57] ABSTRACT

An arm curl exercise apparatus is provided. The arm curl exercise apparatus includes a selectable weight mechanism and an inpact lever mechanisms operatively connected thereto. A pair of four bar linkage mechanisms are connected to the free end of the input lever. A pair of handles are rotationally connected to the forward most bar component of the four-bar linkage mechanisms such that the handles follow the same pivoting movement as the forward most bar component, when the four bar linkage mechanisms are pivoted. When utilizing the rotatably mounted handles the user is able to maintain the proper biomechanical alignment of the joints while choosing from a variety of grips. The paths through which the four-bar linkage mechanisms travel enable the handles to travel along a slightly curvilinear upwardly converging and downwardly diverging path which simulates as natural a human musculoskeletal arm curl motion as possible.

11 Claims, 16 Drawing Sheets

ARM CURL APPARATUS FOR EXERCISING REGIONS OF THE UPPER BODY

RELATED APPLICATIONS

This application claims priority under 35 U.S.C.§119(e) to commonly-owned, co-pending U.S. provisional patent application Ser. No. 60/027,054 entitled "Arm Curl Apparatus for Exercising Regions of the Upper Body", filed Sep. 30, 1996 by Giannelli et al., which is incorporated herein by reference in its entirety.

FIELD OF THE INVENTION

The present invention relates to an apparati for exercising regions of the upper body, and more particularly to an improved arm curl exercise machine.

BACKGROUND OF THE INVENTION

A variety of exercise machines which utilize resistance or strength training have become very popular in recent years. Such strength machines are often used in place of conventional free weights to exercise a variety of muscles within the human body. Most strength machines are designed with the goal of optimizing resistance training benefits to the user by combining adjustable weight resistance with ease of use, while also attempting to maintain proper biomechanical alignment of the user's joints.

While such machines offer convenience and other benefits to the user in comparison to free weights, conventional designs typically include a frame superstructure for providing symmetrical balance and support for various levers and weight components of the machines. Such conventional frame superstructures generally result in machines that are oversized in height, width, and architecture. In addition, many of such conventional machines may be inconvenient to users performing more than one repetition of an exercise with varying weights, as the user is generally required to be physically removed from the machine in order to place weights on, or otherwise select the desired weight force before performing each set.

Another limitation found in conventional strength machines utilizing selectable weights is the inability of the user to perform high velocity exercises. In such conventional machines the weights have inertial problems at higher speeds which can result in inconsistent resistance through a complete range of motion, therefore, users are encouraged to perform the exercises slowly. Training at lower velocities produces greater increases in muscular force at slow speeds for the user. Therefore, low velocity training only improves an individual's capabilities at slower speeds. In contrast, training at higher contractal velocities produces increases in an individual's muscular force at all speeds of contraction at and below the training velocity. Therefore, high velocity training improves an individual's functional capabilities at normal contractal velocities, i.e. velocities utilized for activities such as golfing and tennis which are more likely to be a part of every day living. Although there are many forms of strength training which allow for higher velocity training, the resistance mechanisms of such equipment generally do not include selectable weights, these devices do not utilize selectable weights as part of their resistance mechanism, and many users prefer training with selectable weights as opposed to other forms of resistance training, for example, resistance bands.

Conventional resistance equipment may also be limited by designs that prevent users from maintaining the proper biomechanical alignment of joints through a complete range of motion. A variety of machines have been proposed to improve the range of motion of the user, in order to make the exercise performed through the range more effective. Such machines are disclosed in, but not limited to, U.S. Pat. Nos. 5,437,589 and 5,273,504. However, the equipment disclosed in such references does not consistently provide proper biomechanical alignment of the user's joints through the complete range of motion.

Therefore, a need exists in the field of resistance training for selectable weight equipment that allows users to maintain the proper biomechanical alignment of joints through a complete range of motion, while performing exercises at high contractal velocities.

SUMMARY

In accordance with the invention there is provided an arm curl exercise apparatus comprising a selectable weight mechanism and a pair of four-bar linkage mechanisms operatively connected thereto. The selectable weight mechanism is disposed in an off-center position relative to the exercise ready seating position of the user, such that the user can readily access and manually adjust/select the degree of weight force from a seated, exercise ready position. The selectable weight mechanism is preferably mounted in a relatively short weight support frame, typically less than about 3.5 feet in height. A pair of handles are rotationally connected to the forward most bar component of the four-bar linkage mechanisms such that the handles follow the same pivoting movement as the forward most bar component, when the four bar linkage mechanisms are pivoted. When utilizing the rotatably mounted handles the user is able to maintain the proper biomechanical alignment of the joints while choosing from a variety of grips. A cam and cable are interconnected to the four-bar linkage mechanisms and the shortened selectable weight mechanism such that as the four bar linkage mechanisms are pivoted around their corresponding primary axis, the selected weight is pulled through a relatively short vertical path, preferably about 1 foot.

Accordingly, the present invention provides an arm curl exercise apparatus including a support member and a pair of four-bar linkage mechanisms supported by the support member. The pair of four-bar linkage mechanisms each include a primary lever arm pivotable about a primary axis, a follower lever arm pivotable about a secondary axis, and a handle lever arm. Each handle lever arm includes a first portion pivotally connected to the primary and follower lever arms, a second portion extending inwardly from the first portion, and a handle rotatably connected to the second portion of handle lever arm. A weight mechanism is operatively associated with the pair of four-bar linkage mechanisms. The handles are rotatable at least 180 degrees by the user in order to exercise a wide variety of muscle groups associated with the hands and arms.

In another aspect of the invention, each handle extends outwardly and perpendicularly from the handle lever arm, and curves outwardly and downwardly therefrom at a 90 degree angle, such that the handles travel in a slightly curvilinear upwardly converging and downwardly diverging path as the four-bar linkage mechanisms are displaced between a first position and a second position while maintaining a correct biomechanical positioning.

BRIEF DESCRIPTION OF THE DRAWINGS

It is to be understood that the following drawings are for the purpose of illustration only and are not intended as a definition of the limits of the invention. Objects and advantages of the present invention will become apparent with reference to the following detailed description when taken in conjunction with the following drawings, in which.

DETAILED DESCRIPTION OF THE PREFERRED EMBODIMENTS

Figure 1:
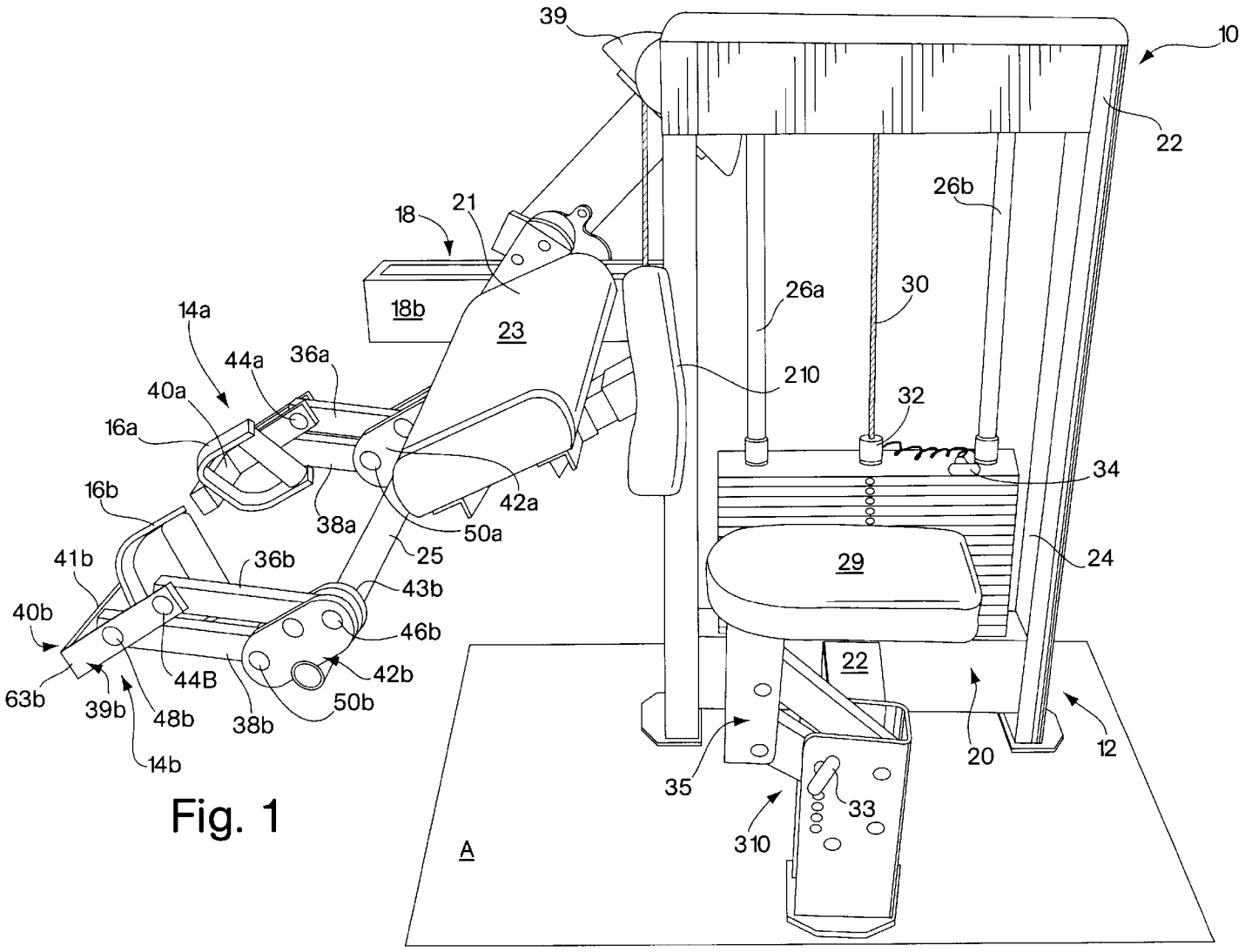
FIG. 1 is a side perspective view of an arm curl apparatus according to the present invention.
Figure 2:
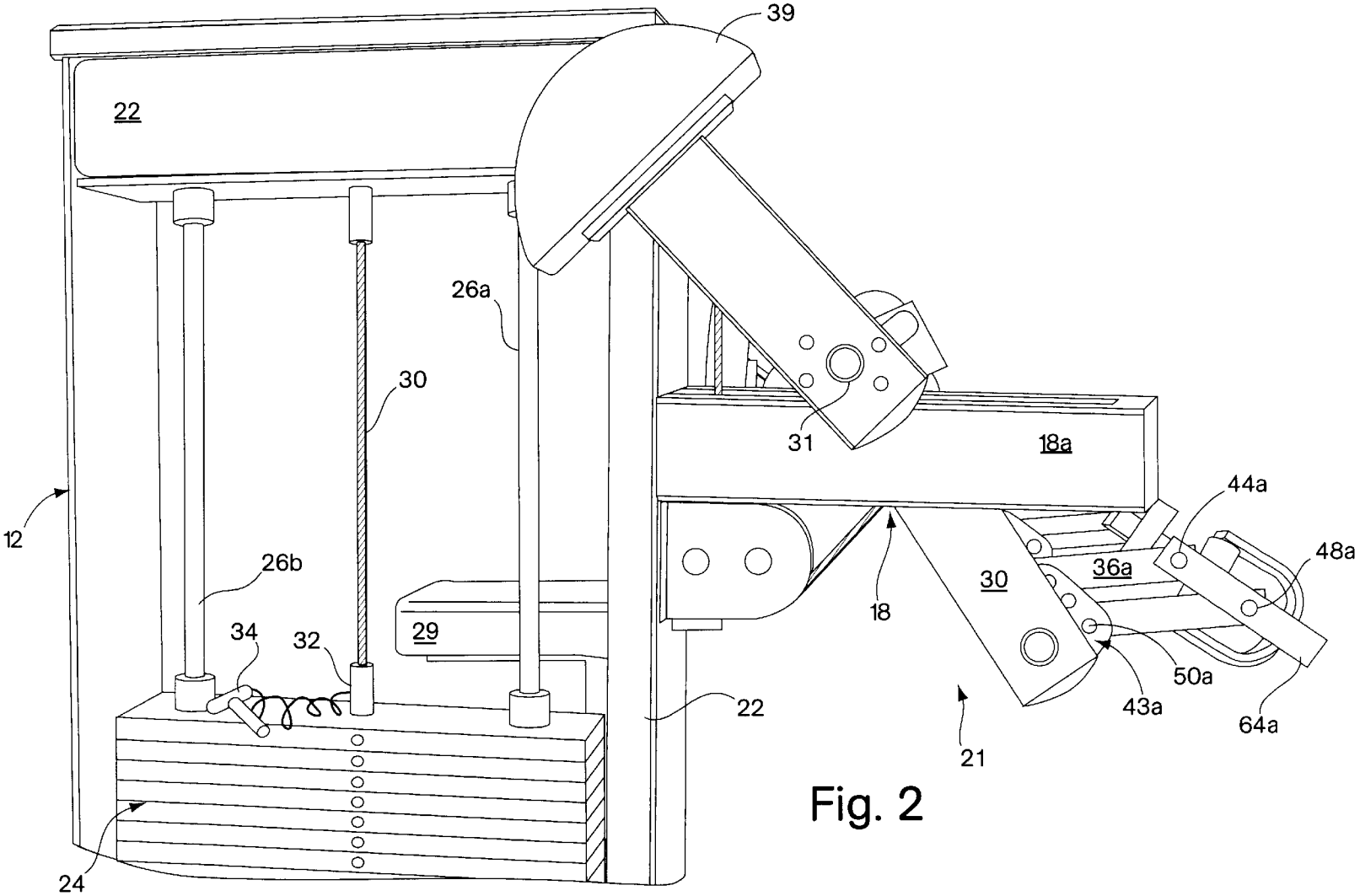
FIG. 2 is a side view of view the arm curl apparatus of FIG. 1 showing the support for the four bar linkage mechanisms.

Referring initially to FIGS. 1 and 2, there is illustrated a perspective and a side view of an arm curl exercise machine 10, according to one embodiment of the present invention. Arm curl exercise machine 10 preferably includes a selectable weight stack 12 operatively connected to each of a pair of four bar linkages 14*a*, 14*b*, a pair of handles 16*a*, 16*b* rotationally connected to the four-bar linkages 14*a*, 14*b*, respectively, a support 18 for supporting the pair of four-bar linkages 14*a, b*, a seat 20, a chest support 210 and an arm rest 23.

With continued reference to FIGS. 1 and 2, the selectable weight mechanism 12 is preferably a high-mass, short-travel (HMST) weight stack. A HMST weight stack provides the user with a higher mass weight stack and a shorter range of travel than conventional weight stacks. By increasing the mass and decreasing the range of travel, the speed of the selected weight decreases during use without slowing down the speed of the user as he or she exercises, as described hereinbelow. As the speed of the weight decreases, so also does the negative inertial effect, allowing a user to train at higher contractal velocities without the associated negative inertial effect associated with conventional selectable weights, as described above. Overcoming the negative inertial effect, in turn, results in a smoother and more predictable resistance through the complete range of motion.

Figure 7:
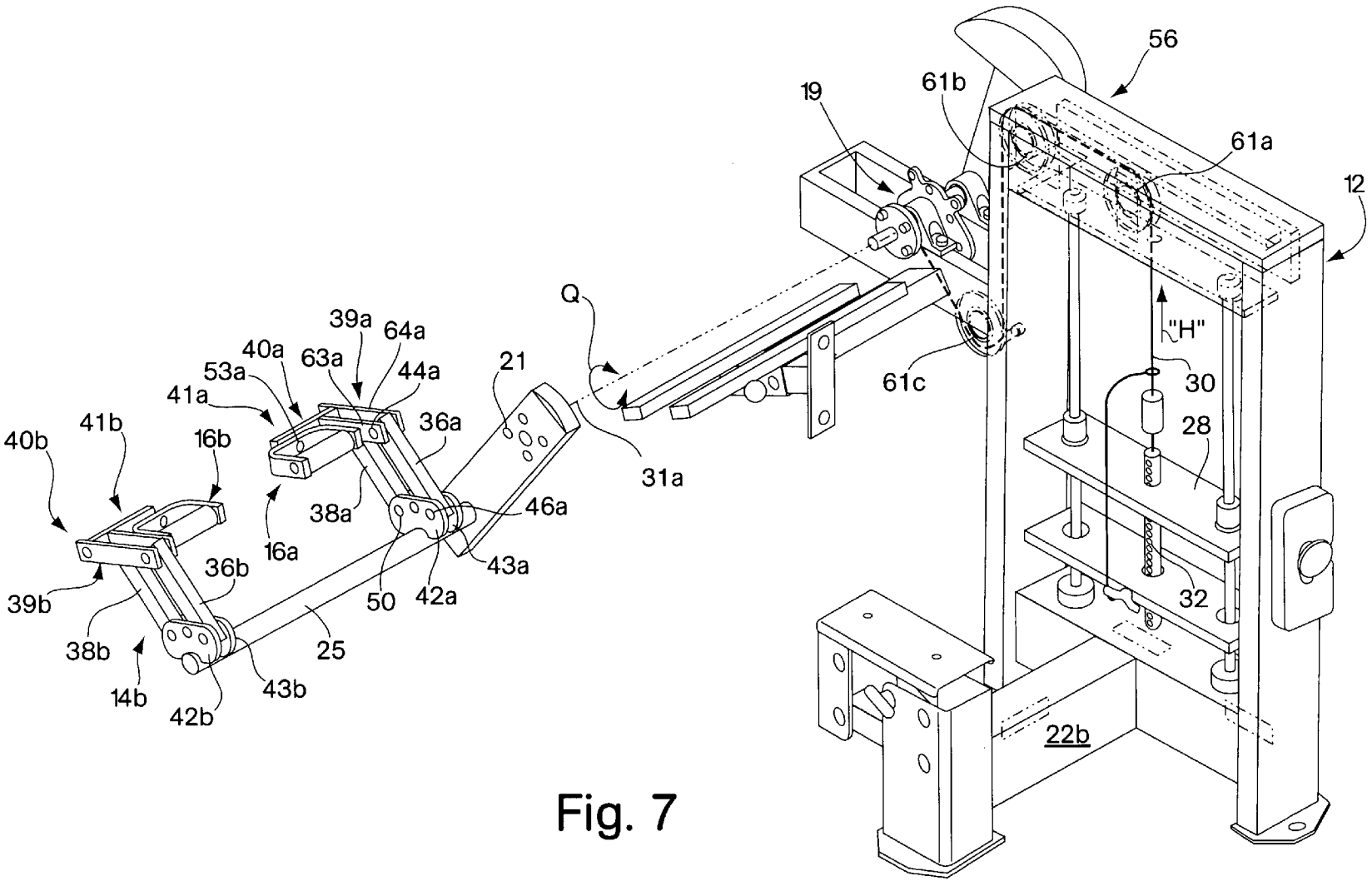
FIG. 7 is an expanded view of the arm curl apparatus of FIG. 1.
Figure 8:
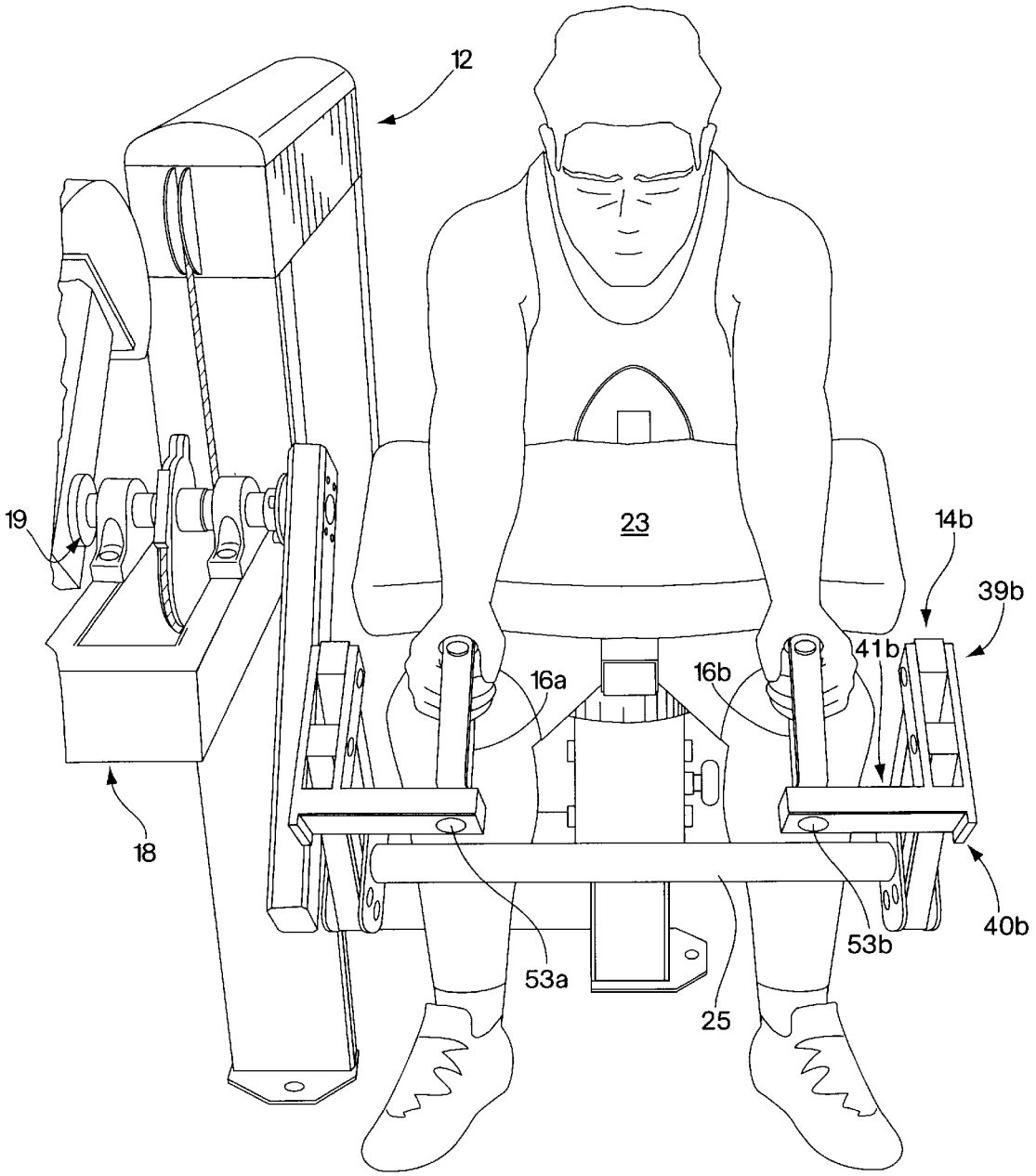
FIG. 8 is an illustration of a user in a starting position engaging the arm curl apparatus of FIG. 1 with a parallel grip.
Figure 9:
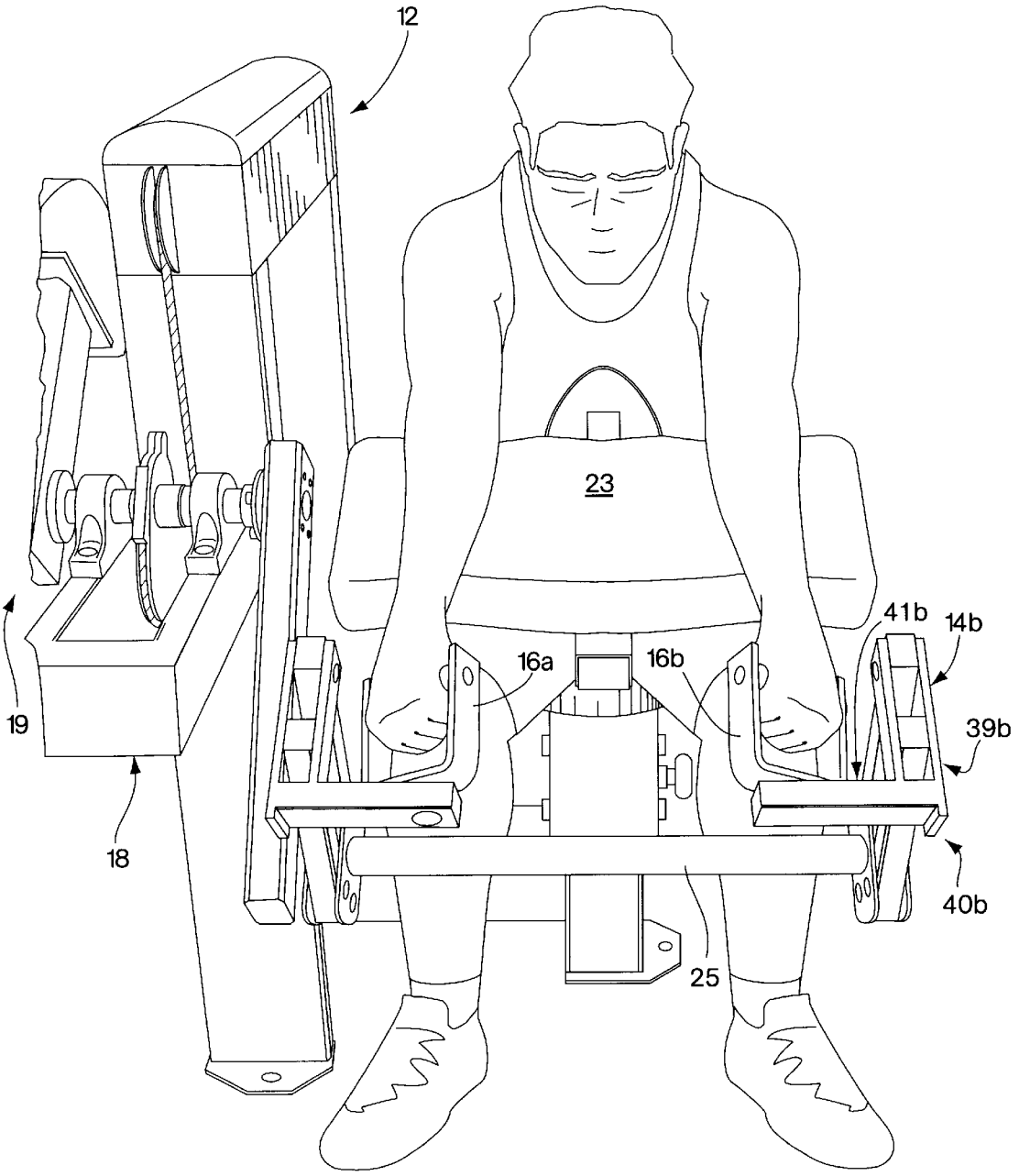
FIG. 9 is an illustration of a user in a starting position engaging the arm curl apparatus of FIG. 1 with a rotated over grip.
Figure 10:
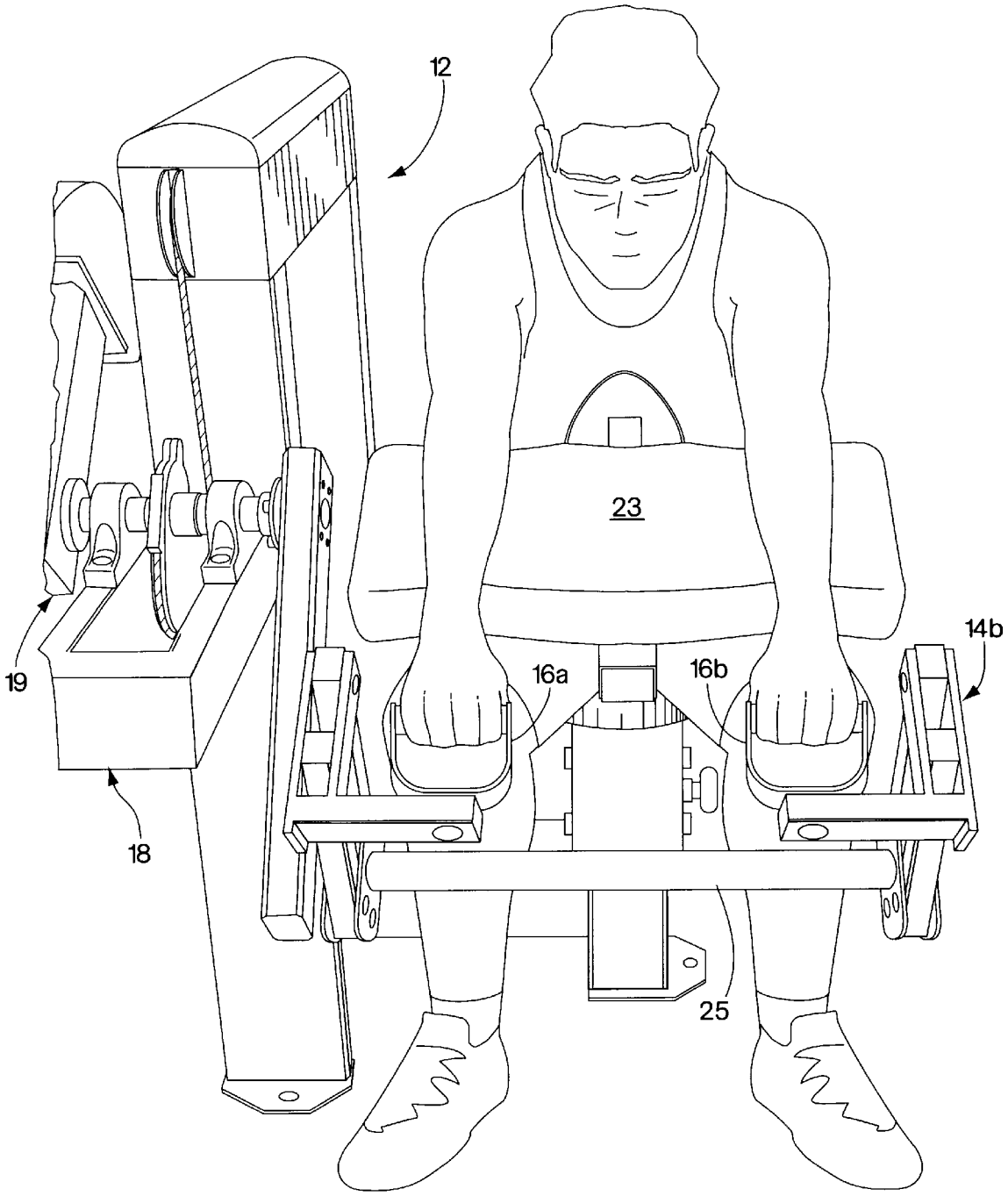
FIG. 10 is an illustration of a user in a starting position engaging the arm curl apparatus of FIG. 1 with a horizontal over grip.
Figure 11:
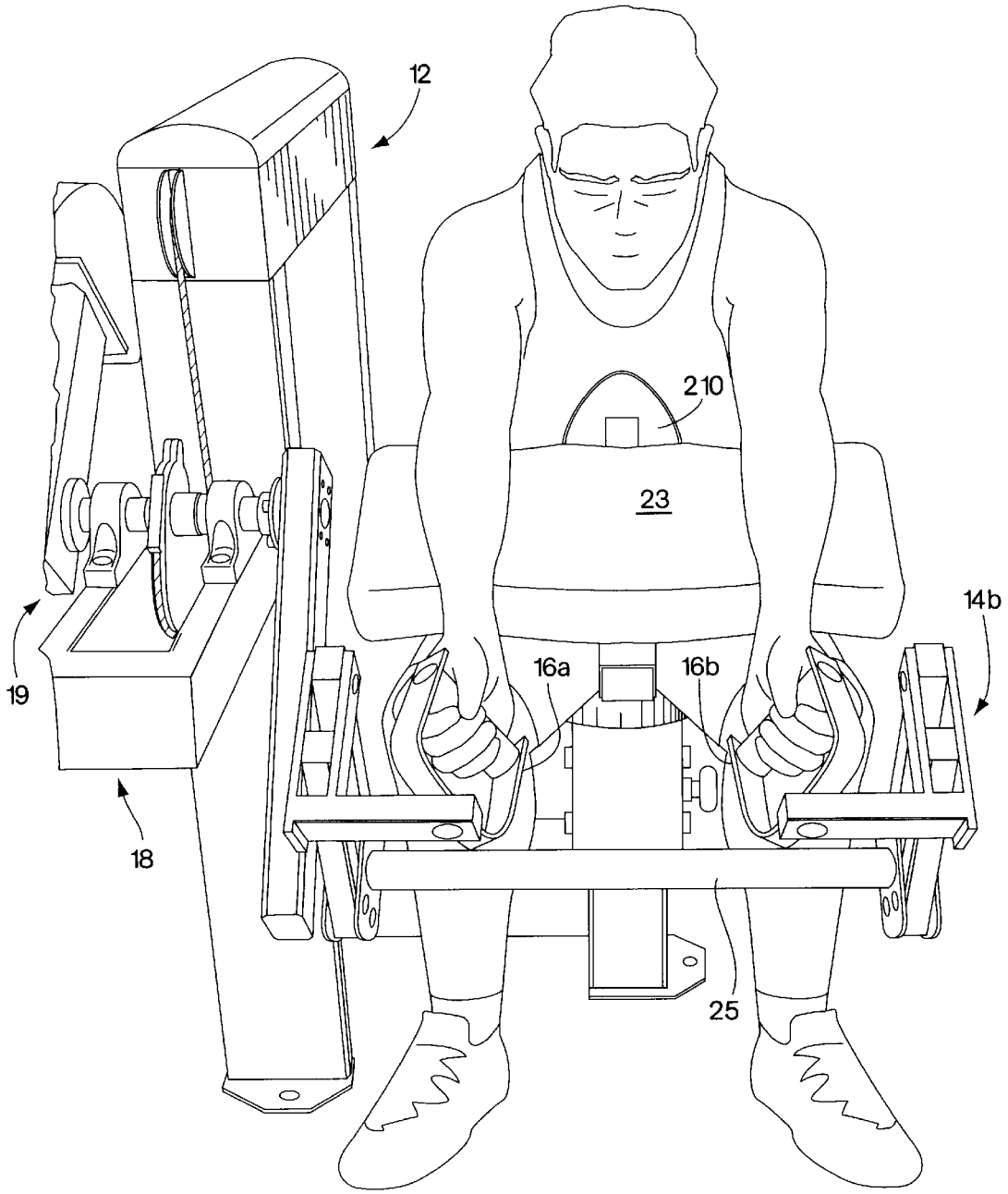
FIG. 11 is an illustration of a user in a starting position engaging the arm curl apparatus of FIG. 1 with a rotated under grip.
Figure 12:
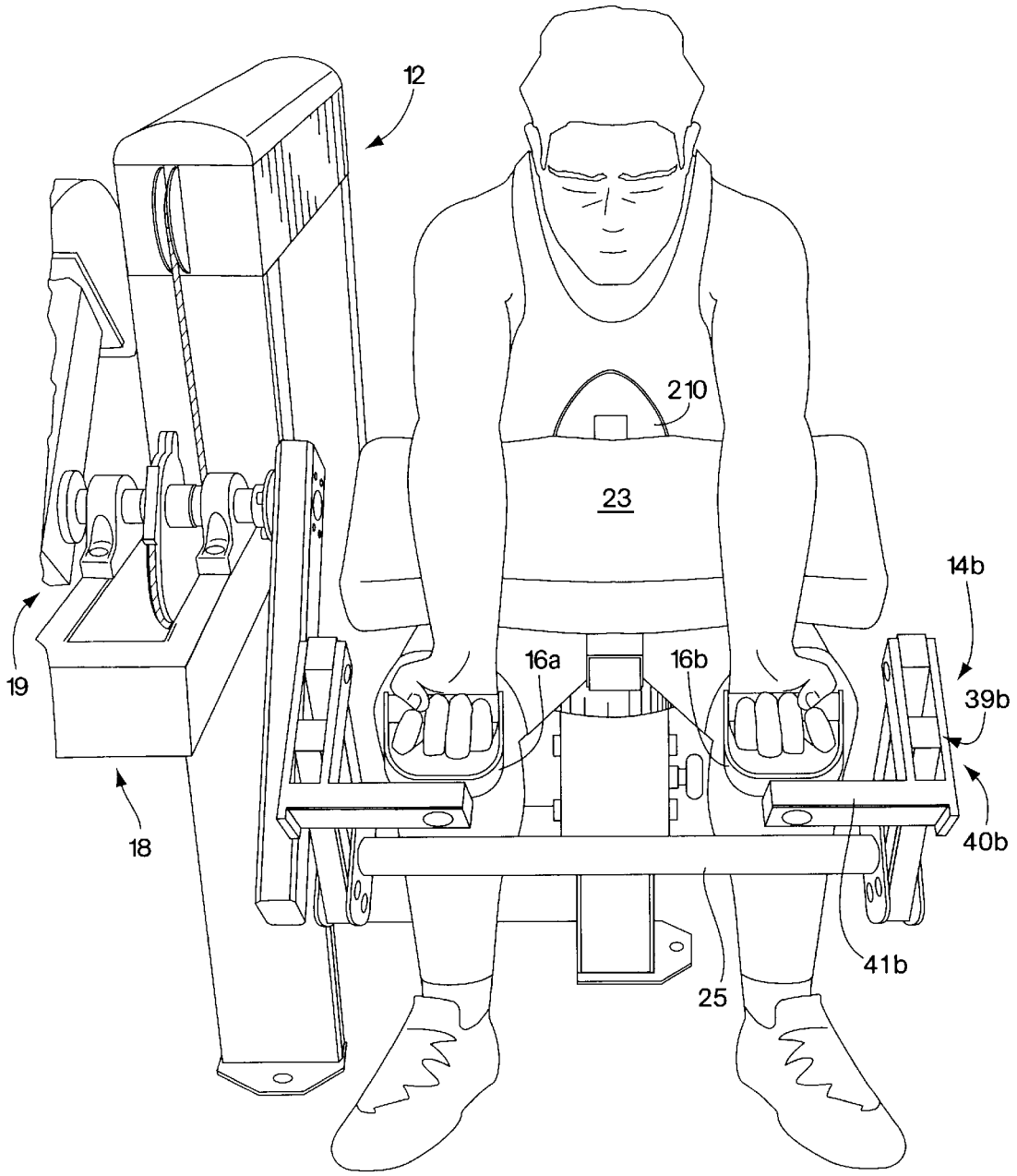
FIG. 12 is an illustration of a user in a starting position engaging the arm curl apparatus of FIG. 1 with a horizontal under grip.
Figure 13:
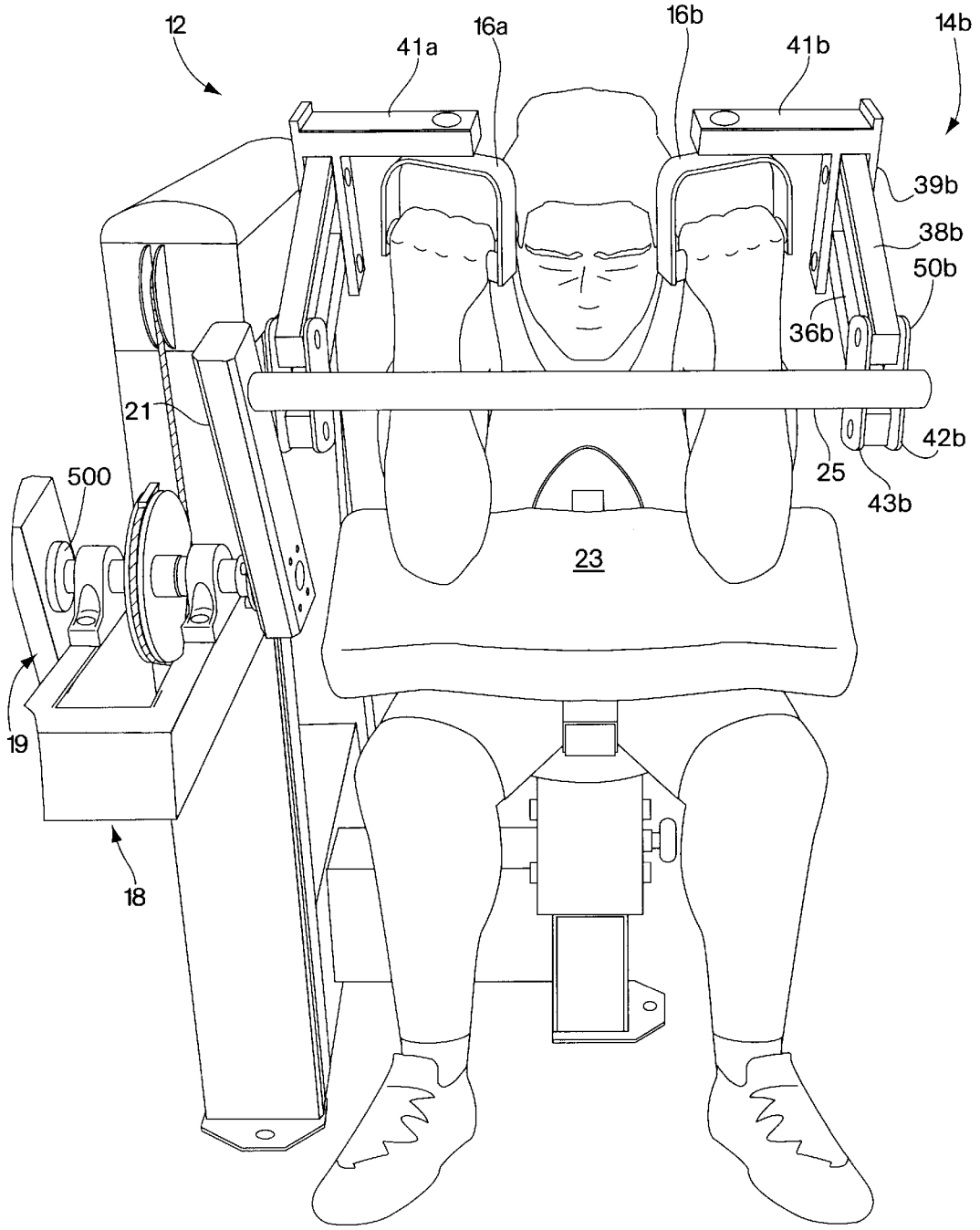
FIG. 13 is an illustration of a user in an active position engaging the arm curl apparatus of FIG. 1 with a rotated under grip.

The selectable weight mechanism 12 is preferably disposed in an off-center position relative to the exercise ready, seating position of the user, such that the user can readily access and manually select or adjust the degree of weight force from a seated, exercise ready position. In the present embodiment, the selectable weight mechanism 12 stands approximately 35 inches in height and preferably includes a housing 22 and a plurality of selectable weight plates 24 supported therein. The housing 22 preferably supports the support 18 and is connected to seat 20 by brace 22*b* (FIG. 7). The total number of selectable weight plates 24 supported within the housing 22 are referred to collectively as a "weight stack". In the present embodiment the weight plates 24 are each approximately 0.75 inches thick, and are uniform in weight at approximately 20 lbs. each. As shown in FIG. 7, a top weight plate 28 is operatively connected to a cable 30 and a central rod 32. The central rod 32 extends in a downward direction from the top weight plate 28 through each of the consecutive weight plates 24. A pin 34 is insertable through a transverse hole in each plate, and through the central rod to select or adjust the desired amount of weight for the exercise routine to be performed, as is known in the art. The weights 24 are movable in first and second substantially vertical directions along guide rods 26*a* and 26*b*, respectively, as will be described in greater detail hereinbelow.

Figure 16:
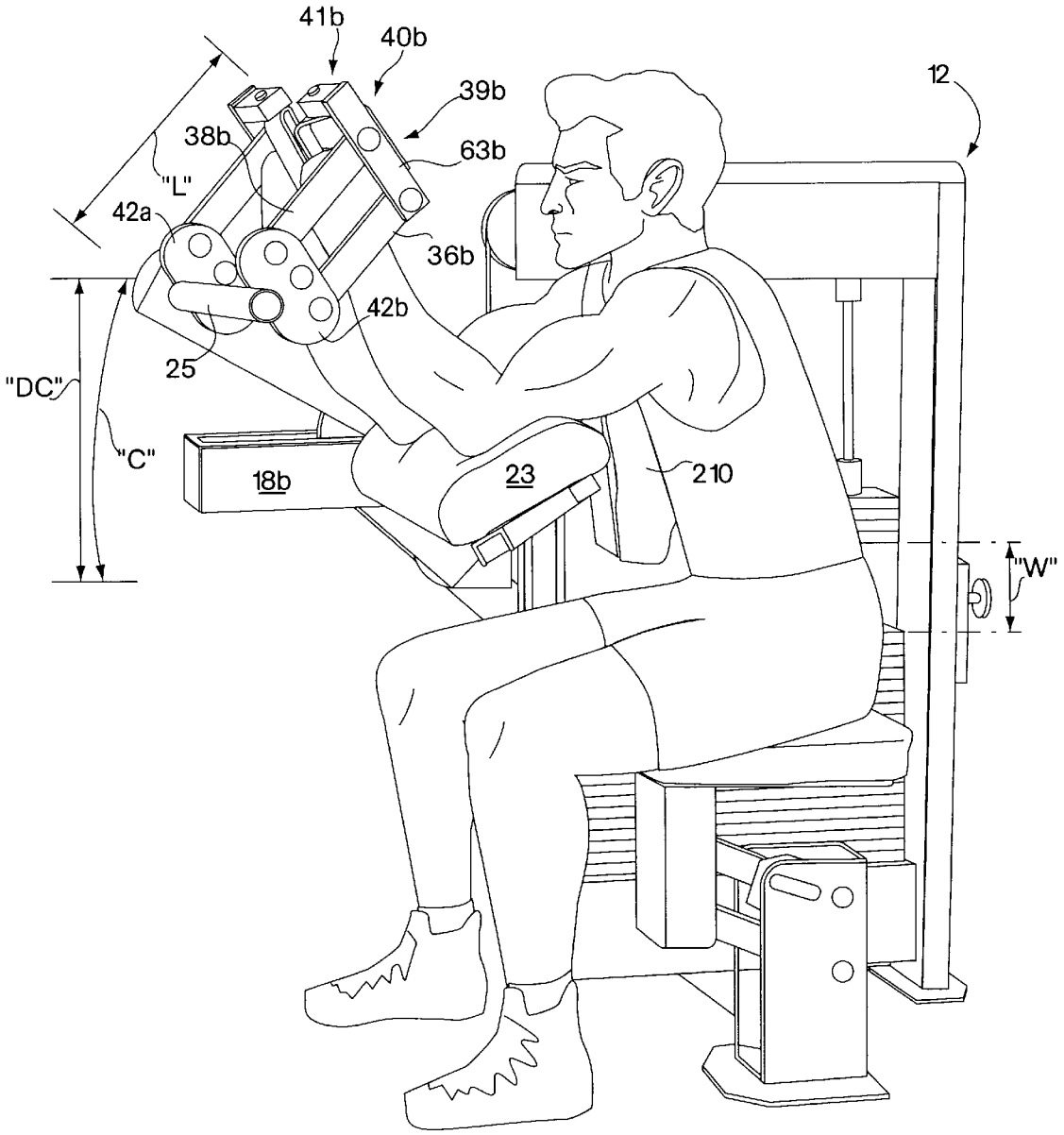
FIG. 16 is a perspective view of a user in an active position showing the direction of movement of the four-bar linkages.

In the present embodiment, the selectable weight plates 24 preferably have a total mass of 300 lbs, which is twice the conventional mass (150 lbs) utilized with an arm curl machine. The selected weight plates 24 travel at approximately half the speed of a selected weight plate of a conventional arm curl machine. Therefore, the selected weight is also subjected to approximately half the acceleration over approximately half the distance of a conventional selected weight plate utilized with a conventional arm curl machine. As shown in FIG. 16, the distance "W" that the selected weight plates travel is approximately 43% of the distance "DC" traveled by a user's hand, in the present embodiment, as measured by the distance between the vertical positions of handles 16*a* and 16*b* at the start and stop of the exercise. The distance "DC" is a function of the length of the user's arm. The distance a user's hand travels from the beginning to the end of one repetition of the exercise defines a complete range of motion. Although the mass is doubled, the total load the user feels during the performance of an exercise routine is the same as with a conventional arm curl machine. In the present embodiment, this effect is achieved by changing the mechanical advantage to increase the leverage the user has over the selected weight plates from 1.15:1 (force exerted by user:weight) in a conventional system, to an approximately 2.3:1 ratio for the present system. Such increase in leverage ratio is preferably over about 1.5:1, and is typically from 2:1 to 4:1. The ratio is changed by attaching cable 30 through a reducer cam assembly 19 (FIG. 3) in the present embodiment, as described herein below. One of ordinary skill will recognize that the leverage ratio may be changed by attaching the cable 30 in other manners, as determined by conventional engineering techniques.

Cam assembly 19 (FIGS. 3 and 4) is utilized to provide the user with the necessary mechanical advantage, i.e. leverage, as described above. In the present embodiment, cam assembly 19 is approximately 50% reduced in size from a conventional arm-curl cam assembly, and is mounted about rotational axle 31 which defines axis "x". Cam assembly 19 is operatively connected to an input arm 21, which is, in turn, operatively connected by axle 25 (FIG. 7) to four bar linkages 14*a*, 14*b*, as described herein below. Cam assembly 19 is also operatively connected to counter balance 39. In the present embodiment, cam assembly 19 is secured to support 18 by a pair of bearing supports 27*a, b*, and preferably includes a groove 26 disposed in cam component 500 for receipt of cable 30. The cam component 500 is fixedly attached to axle 31, which is rotatably mounted in supports 27*a*, 27*b* so as to allow for rotation of axle 31 around axis "x", the axle 31 being mounted by flange 34*a* to counter balance 39 at one end and is mounted by mounting flange 34*b* to input arm 21 at a second, opposite end and includes the operative components of cam assembly 19 mounted therebetween.

Figure 6:
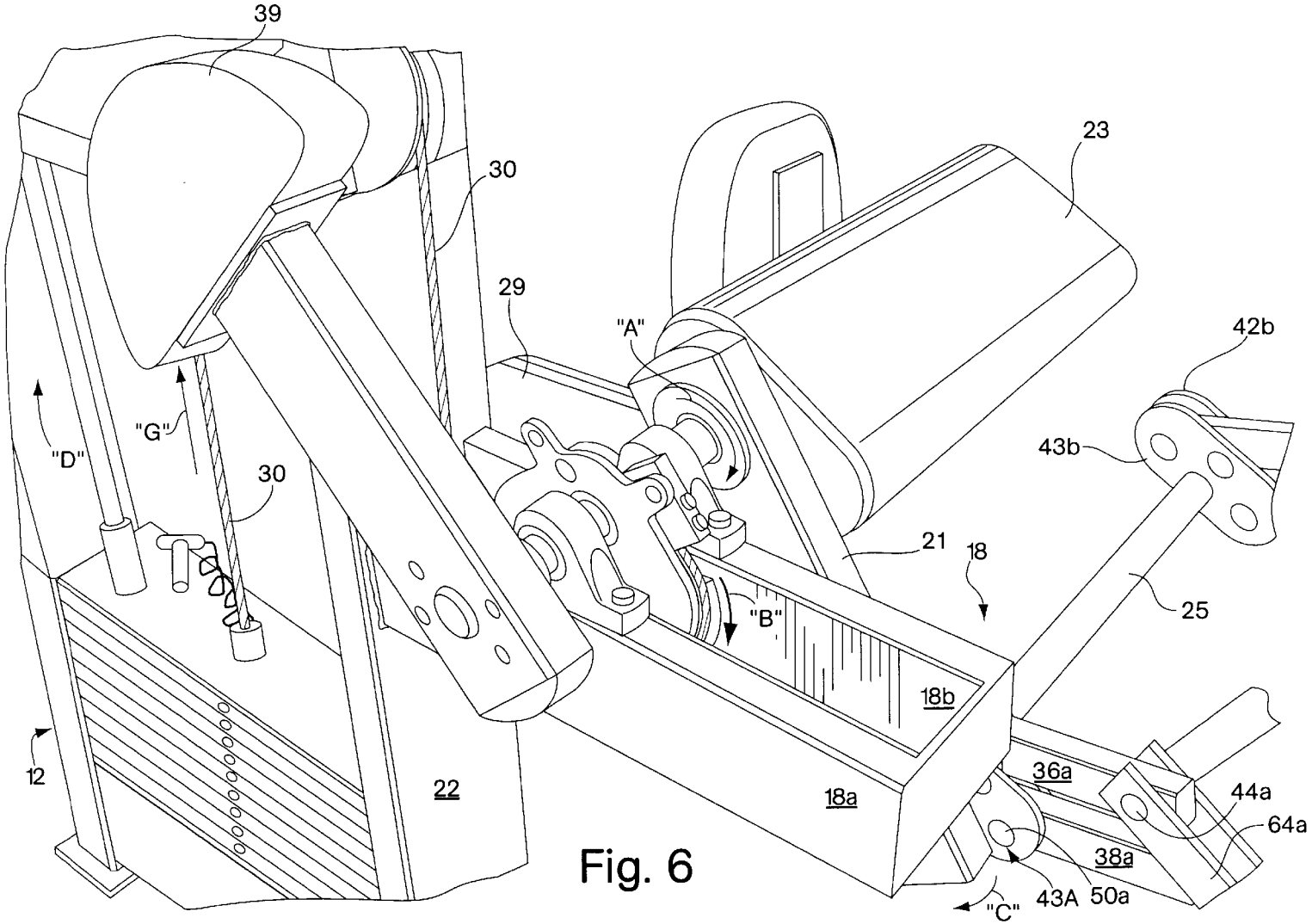
FIG. 6 is an enlarged view of a portion of the arm curl apparatus of FIG. 1 showing he rotation of the cam assembly.

As shown in FIG. 6, rotation of axle 31 in the direction of arrow "A" causes corresponding rotation of cam assembly 19 in the direction of arrow "B", input arm 21 in the direction of arrow "C" and counter balance 39 in the directions of arrow "D". This, in turn, operates to move cable 30 in the direction of arrow "G" to lift the selected weight. The contour of groove 26, the size of cam component 500, and the position and connection of axle 31 to cam component 500 are preselected so as to enable the user to lift the weight stack smoothly through the shortened length of travel relative to the length of travel of the user's hands and with the increased leverage ratio mentioned above. As the input arm 21 rotates in the direction of arrow "C" (FIG. 7), around axis 31*a* (FIG. 7), cam component 500 rotates and cable 30 in turn travels within groove 26 and around pulleys 61*a–c*, thus raising or lowering the selected weights. It should be understood, however, that the cam assembly 19 is only one method to achieve the desired leverage, other equivalent methods will be readily known to one of skill in the art. The desired leverage is in turn dependant upon the percentage increase in the mass of the weights, the criteria being that the user should not feel the increase in mass from a conventional machine while exercising. The increase in mass is, in turn, determined by several considerations, such as cost, structural load placed on the apparatus by the mass, as well as the ability to readily achieve the desired leverage for a given mass.

Figure 3:
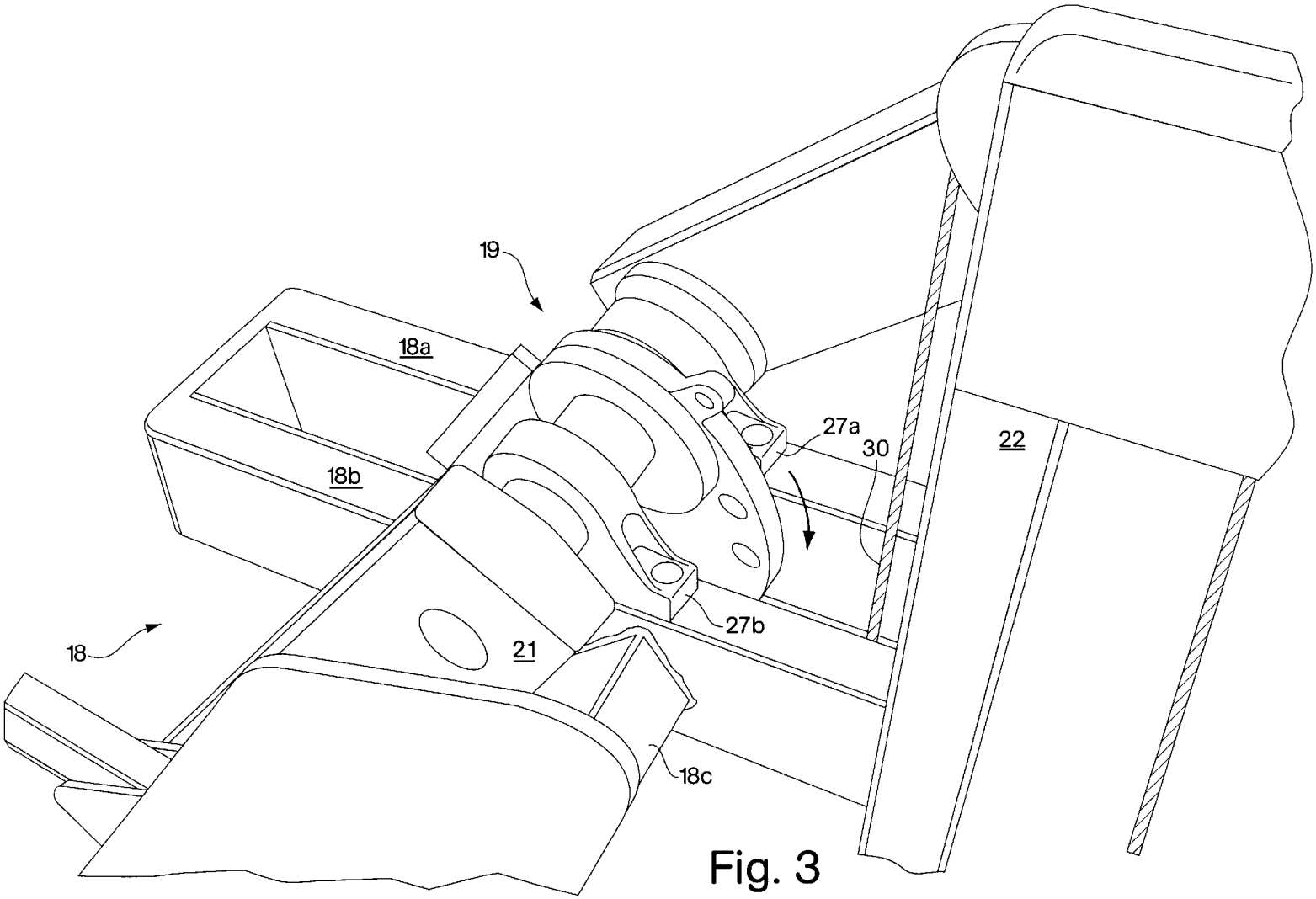
FIG. 3 is an enlarged view of a portion of the arm curl apparatus of FIG. 1 showing the cam assembly.

With continued reference to FIG. 3, support 18 is preferably constructed of a rigid material, such as steel, and includes a pair of post members 18*a*, 18*b*, and a support arm 18*c*, of which combine to form the structural elements of support 18. Post members 18*a*, 18*b* are each secured to frame 22 of weight mechanism 12 and extend in a substantially perpendicular with respect thereto. Support arm 18*c* extends substantially perpendicular from post member 18*b*, adjacent input arm 21, and operates to support armrest 23. It will be understood to one of skill in the art that any number of structural elements, having a variety of shapes, sizes and orientations, may be utilized to form support 18, as long as the structural orientation supports the four bar linkages.

Figure 15:
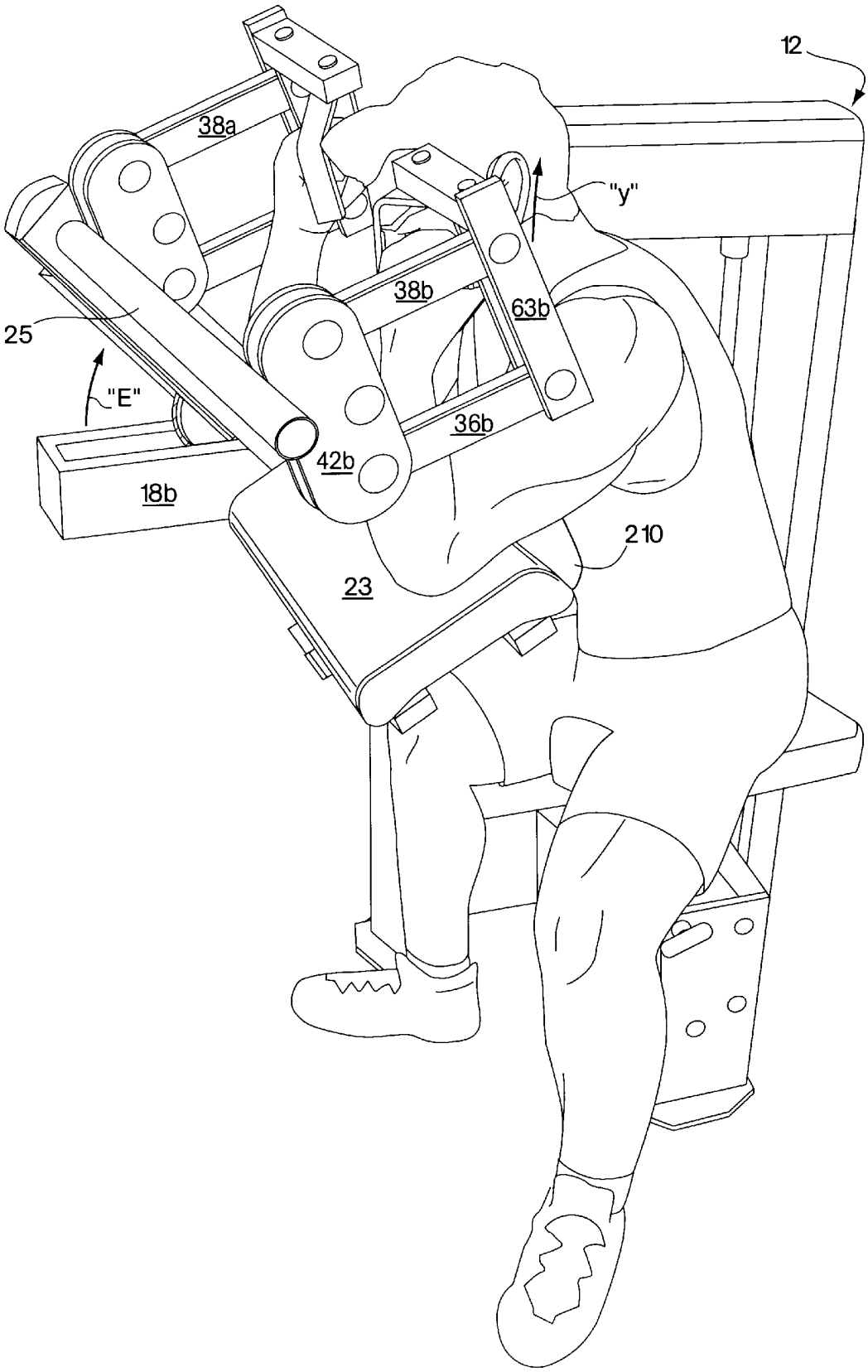
FIG. 15 a perspective view of a user in an active position showing the direction of movement of the four-bar linkages.

With continuing reference to FIG. 1, seat 20 includes a seat cushion 29 supported by a support 310, and is preferably adjustable between a plurality of positions. In the present embodiment, adjustment of seat 20 is preferably enabled through a four-bar, gas-assist seat adjustment 35, although other methods of adjustment, for example hydraulic, may be utilized. A pin 33 is insertable through each of a plurality of holes, in order to select the desired height of the seat. As with support 18, seat 20 may be designed in a variety of configurations and dimensions, and may, or may not be adjustable. Preferably located adjacent seat 20 and spaced therefrom is chest support 210. Chest support 21 engages and supports the chest of a user in the forward facing direction, as shown in FIGS. 15 and 16.

Figure 5:
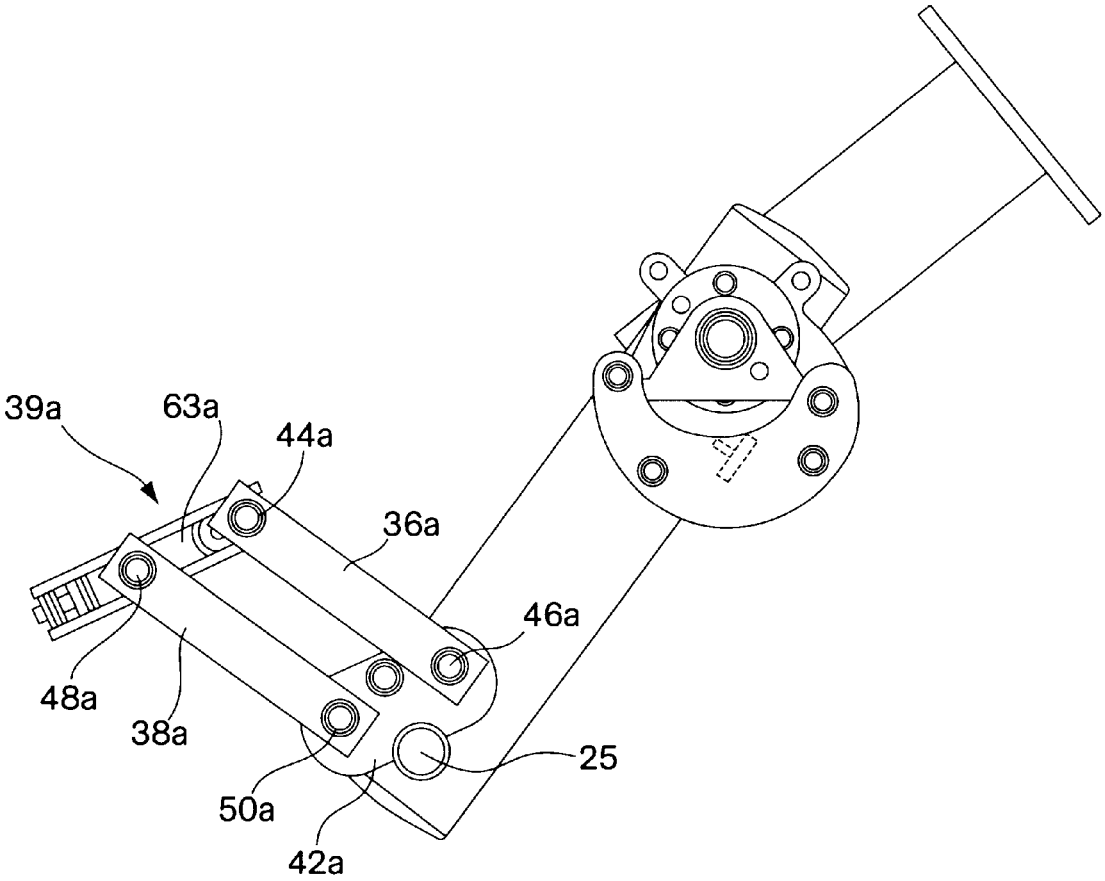
FIG. 5 is an expanded view of a four-bar linkage mechanism of the arm curl apparatus of FIG. 1.

With reference now to FIGS. 5 and 7, four bar linkages 14*a*, 14*b* are mounted at opposite ends to axle 25, and are operatively associated with the selectable weight stack 12, as will be described in greater detail herein below. Four bar linkages 14*a*, 14*b* are symmetrical in construction, therefore, the below detailed description of linkage 14*a* is applicable to symmetrical linkage 14*b* as well. Four bar linkage 14*a*, having a length "L" (FIG. 16), preferably includes primary lever arm 36*a*, a follower lever arm 38*a*, a handle lever arm 40*a* and a support plate 42*a*. Primary lever arm 36*a* is pivotally connected at a first end to a first portion 39*a* of handle lever arm 40*a* between handle lever arm extensions 63*a* and 64*a*, by pin 44*a*, and is pivotally connected at a second end, opposite the first end, between support plates 42*a* and 43*a*, by pin 46*a*. Follower lever arm 38*a* is likewise pivotally connected at one end to the first portion 39*a* of handle lever arm 40*a*, between handle lever arm extensions 63*a* and 64*a*, by pin 48*a*, and is pivotally connected at a second end, opposite the first end, between support plates 42*a* and 43*a*, by pin 50*a*. Follower lever arm 38*a* is preferably parallel to primary lever arm 36*a*. In the present embodiment, axle 25 is preferably disposed parallel to a horizontal plane "A" underlying machine 10 (FIG. 1).

With continuing reference to FIG. 1, handle lever arm 40*a* preferably includes a first portion 39*a* pivotally connected to the primary and follower lever arms 36*a* and 38*a*, and a second portion 41*a* extending inwardly at substantially a right angle from the first portion 39*a*. Handle 16*a* is preferably "U" shaped and is preferably pivotally or rotatably connected to the second portion 41*a* of handle lever arm 40*a*. In the present embodiment handle 16*a* is pivotally or rotatably connected to handle lever arm 40*a*, by pin 53*a* (FIG. 8), although other sizes and attachment methods may be utilized provided, however, that handle 16*a* can pivot approximately 180–360 degrees about pin 53*a* with respect to handle lever arm 40*a* as shown in FIGS. 8–16. Handle 16*a* is also preferably covered with foam for user comfort.

Figure 4:
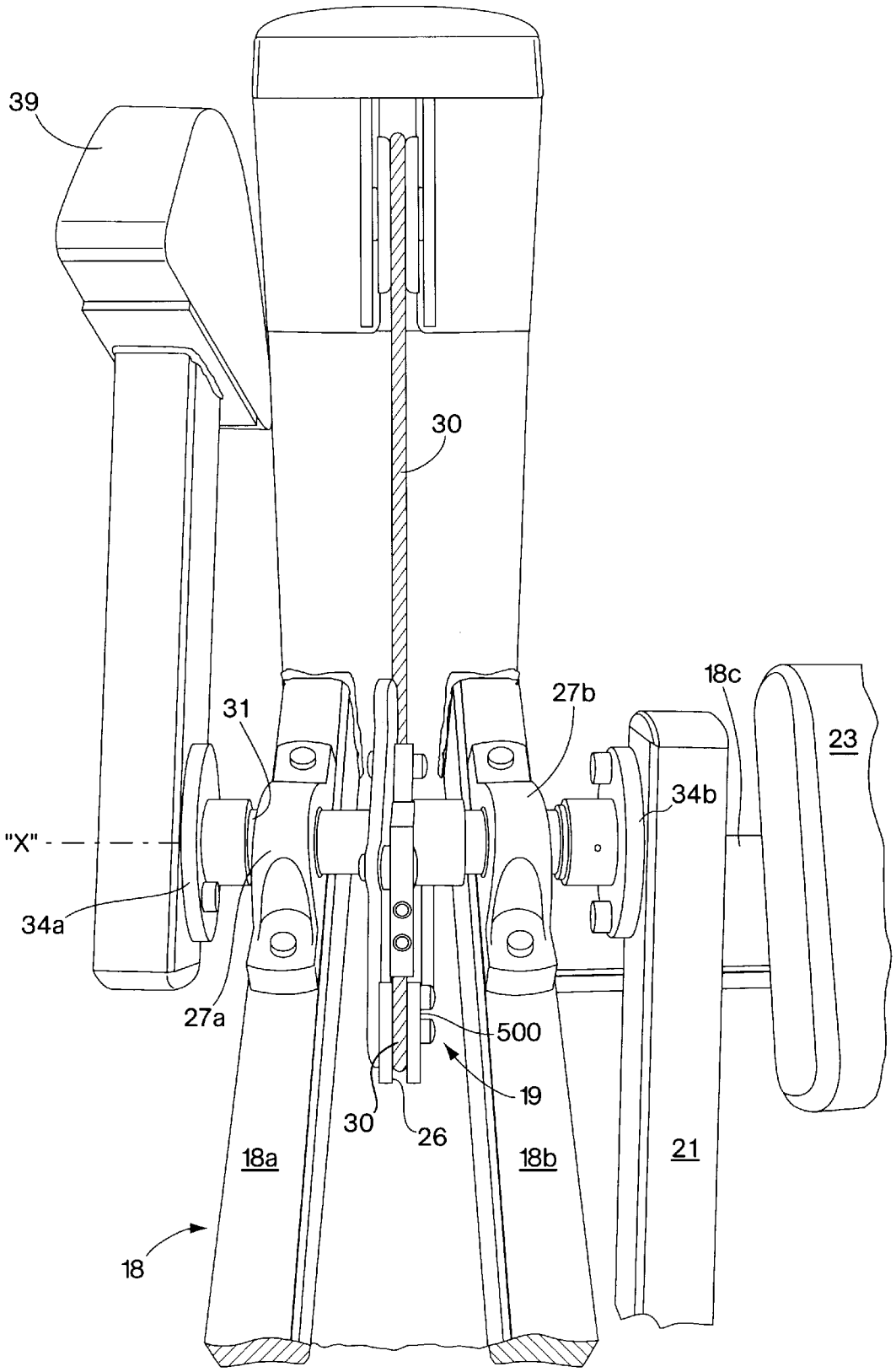
FIG. 4 is an enlarged view of portion of the arm curl apparatus of FIG. 1 showing the cam assembly.
Figure 14:
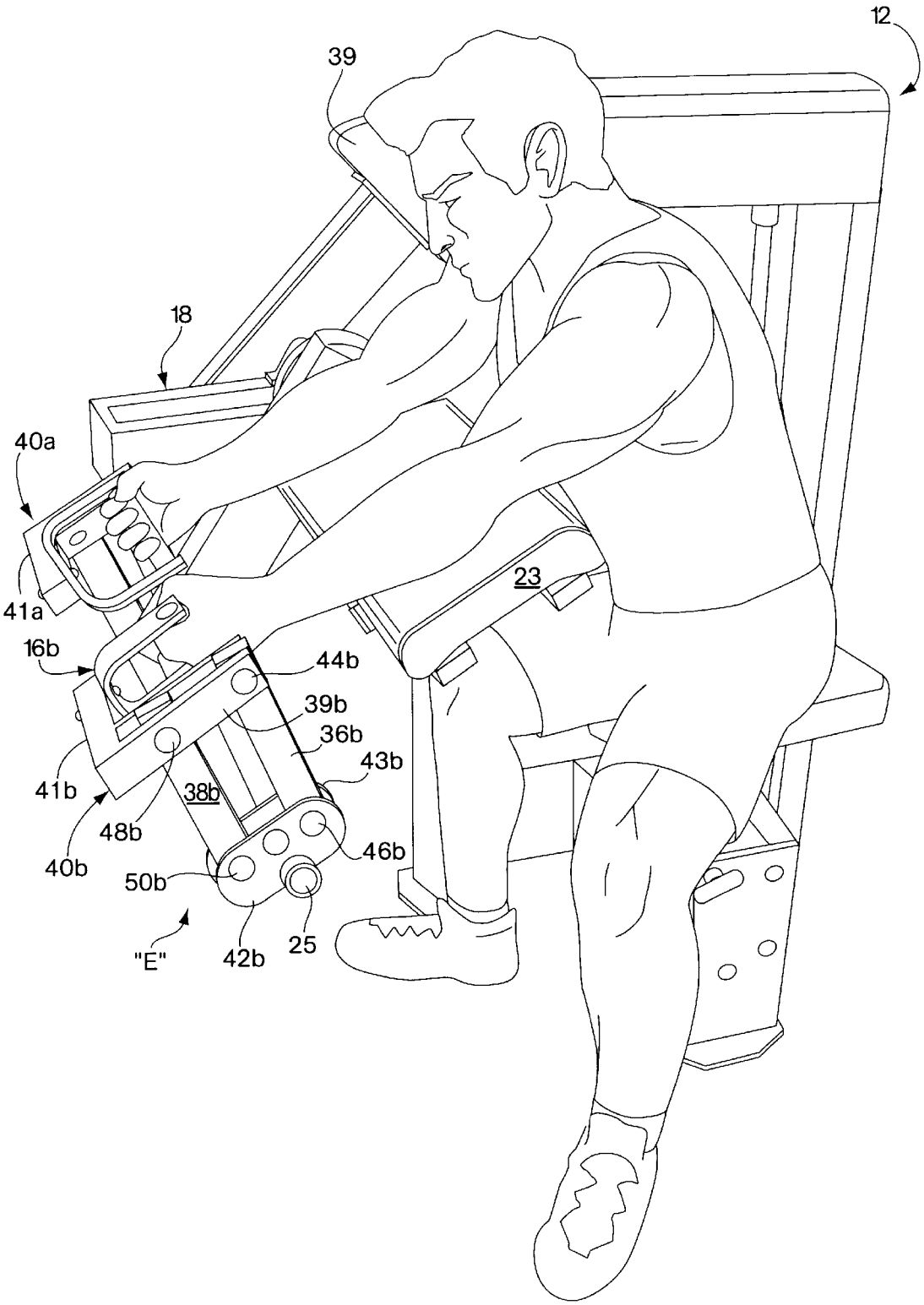
FIG. 14 is a perspective view of a user in a starting position showing the direction of movement of the four-bar linkages.

Referring to FIGS. 4 and 7, pulley system 56 preferably includes a cable 30 attached at a first end to central rod 32 and is attached at a second end to cam 500. In order to effectuate movement of the weight stack by actuation by the four bar linkages, cable 30 is routed from central rod 32, through a plurality of secondary pulleys 61*a, b, c*, respectively and through cam 500, where it is received within , groove or slot 26 of a cam member 500 and secured thereto, as described above. In operation, a user will begin from a starting position, as shown in FIG. 14, and pull handles 16*a, b*, an upward direction, indicated by arrow "E". As the handles are pulled on, as shown in FIG. 14, both primary lever arms 36*a ,b* operate to move axle 25 and hence input arm 21 and cam 500 to put cable 30 in a state of tension, which in turn puts tension on central rod 32, as described above. The tension on central rod 32 is sufficient to move the rod in the direction of arrow "H" (FIG. 7), from an initial, at rest position, to a second, active position, against the force of the selected weights.

The operation of the arm curl machine 10 will now be described with reference to FIGS. 1–16. Prior to performance of an exercise routine, a user will first adjust seat 20 to a desired position in which the user's feet will preferably be in contact with floor A. The user then selects the desired weight for performance of the exercise by inserting pin 34 into the transverse hole of the appropriate weight plate, as described above. Due to the off-center orientation of weight mechanism 12 with respect to seat 20, the user may select the weight from either a seated or a standing position. In either case, after the weight has been selected the user should be seated in seat 20 with the user's chest preferably resting against chest support 21. The direction the user is facing is considered the forward facing direction for purposes of this invention. After the user is properly seated, the user will rest his or her arms on arm rest as shown in FIGS. 8–12. Arm rest 23 provides support to the user's arms during performance of the exercise routine. The user will then grasp the "U" shape handles with either hand. Once the user has grasped the handles 16*a*, 16*b*, the user is ready to perform a an arm curl exercise.

The user performs the arm curl exercise by first pulling on handles 16*a*, 16*b* in a tilted upward direction as indicated by arrow "E" (FIG. 14 and 15). As the user begins pulling in the direction as indicated by arrow "E", the bottom end 41*a* of handle lever arm 40*a* begins to rotate slightly in the direction of arrow "Y", which results in a slight tilt of handles 16*a, b* through the range of motion of the exercise. This slight tilt is enabled by the four-bar linkage mechanisms 14*a, b* in order to maintain proper biomechanical alignment of the user's wrist and forearm during performance of the exercise, regardless of the grip. "Proper" or "correct biomechanical positioning," as used herein, means that the orientation of the user's wrist and forearm may remain relatively constant from the start to finish of an arm curl exercise motion, i.e., throughout a complete range of motion. This may also mean that it is not necessary for the user to adjust their hand position on the handles while exercising.

As the user continues to move handles 16*a, b* in the upward direction, he or she may choose to rotate handles 16*a*, 16*b*, clockwise or counterclockwise, as shown in FIGS. 8–16 and described above. This movement allows a user to exercise a wide variety of muscle groups associated with the hands and arms.

Four bar linkages 14*a, b* and rotatable handles, 16*a, b*, enable as natural a human musculoskeletal upward pulling motion as possible while maintaining proper biomechanical alignment of the user's joints in an arm-curl exercise. As the user is pulling handles 16*a, b* in the upward direction, cable 30 is placed in a state of tension by cam component 500 which operates to move the selected weights vertically, in an upward direction within housing 22. Once the user has fully pulled his or her arms in an upward direction, as shown in FIG. 1 5, the user then allows handles 16*a, b* to return to the starting position for the exercise. While the user is allowing handles 16*a, b* to return to the start position, the selected weights are moving in a vertical, downward direction, within housing 22. Once the user reaches the starting point of the exercise, one repetition has been completed through the range of motion of the user.

It will be understood that various modifications may be made to the embodiment disclosed herein. For example, all lengths and angles given are approximate and may be varied by one of skill in the art, the machine may be utilized with, or without a high-mass, short-travel weight stack, the machine may be utilized with or without a seat, the primary handles may be a variety of shapes, other than "U". Therefore, the above description should not be construed as limiting, but merely as exemplifications of a preferred embodiment. Those skilled in the art will envision other modifications within the scope spirit of the invention.

What is claimed is:

1. An arm curl exercise apparatus, comprising:

a support;

an input arm having one end rotatably connected to the support and a free end;

a pair of four-bar linkage mechanisms each including a primary lever arm pivotal about a primary axis, a follower lever arm pivotal about a secondary axis and a handle lever arm pivotally connected to the primary and follower lever arms the primary and secondary axes of each four-bar linkage being connected to the free end of the input arm;

a handle connected to each hand lever arm; and a weight mechanism connected to the input arm to resist rotation of the input arm; and an arm rest connected to the support for supporting an elbow of a user grasping the handles.

2. The arm curl exercise apparatus of claim 1, further comprising a counter balance connected to the input arm.

3. The arm curl exercise apparatus of claim 1, further comprising a seat for supporting a user in a position to engage the handles.

4. The arm curl exercise apparatus for claim 3, further comprising a means for adjusting the seat's height.

5. The arm curl exercise apparatus of claim 1, further comprising a chest support for supporting a user in a position to engage the handles.

6. The arm curl exercise apparatus of claim 1, wherein the weight mechanism includes a selectable weight stack.

7. The arm curl exercise apparatus of claim 6, wherein the weight stack is connected to the input arm by a cable and cam.

8. The arm curl exercise apparatus of claim 1, wherein the weight mechanism is connected to the input arm so as to bias the input arm to a start position and resist rotation of the input arm from the start position in an upward direction.

9. The arm curl exercise apparatus of claim 1, wherein the input arm is connected to the supported to one side of the arm rest.

10. The arm curl exercise apparatus of claim 1, wherein the handles are rotatably connected to the handle lever arms.

11. The arm curl exercise apparatus of claim 10, wherein the handles are rotatable through at least 180 degrees.

* * * * *

UNITED STATES PATENT AND TRADEMARK OFFICE

CERTIFICATE OF CORRECTION

PATENT NO. : 6,056,678
APPLICATION NO. : 08/940894
DATED : May 2, 2000
INVENTOR(S) : Raymond Giannelli et al.

It is certified that error appears in the above-identified patent and that said Letters Patent is hereby corrected as shown below:

On the title page, item (73) Assignee:

delete "Cybex Inaternational, Inc." and insert therefor --Cybex International, Inc.--.

Signed and Sealed this

Thirteenth Day of October, 2009

David J. Kappos

David J. Kappos
*Director of the United States Patent and Trademark Office*